US011318774B2

(12) United States Patent
Harada et al.

(10) Patent No.: US 11,318,774 B2
(45) Date of Patent: May 3, 2022

(54) MEDIUM PROCESSING APPARATUS AND RECORDING SYSTEM

(71) Applicant: Seiko Epson Corporation, Tokyo (JP)

(72) Inventors: Yutaro Harada, Shiojiri (JP); Kohei Ueno, Matsumoto (JP); Nobuyuki Mizushima, Shiojiri (JP); Shunpei Yamaguchi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/381,753

(22) Filed: Jul. 21, 2021

(65) Prior Publication Data

US 2021/0347598 A1 Nov. 11, 2021

Related U.S. Application Data

(63) Continuation of application No. 16/721,161, filed on Dec. 19, 2019, now Pat. No. 11,104,537.

(30) Foreign Application Priority Data

Dec. 21, 2018 (JP) ..... 2018-240142

(51) Int. Cl.

| | |
|---|---|
| ***B65H 37/04*** | (2006.01) |
| ***B42B 2/00*** | (2006.01) |
| ***B41J 11/00*** | (2006.01) |
| ***B42C 1/12*** | (2006.01) |
| ***B65H 31/10*** | (2006.01) |

(52) U.S. Cl.

CPC ..... *B42B 2/00* (2013.01); *B41J 11/002* (2013.01); *B41J 11/0022* (2021.01); *B41J 11/0024* (2021.01); *B41J 11/00242* (2021.01); *B42C 1/125* (2013.01); *B65H 31/10* (2013.01); *B65H 37/04* (2013.01)

(58) Field of Classification Search

CPC ..... B65H 31/10; B65H 37/04; B42C 1/125; B41J 11/002

USPC ..... 270/37, 58.07

See application file for complete search history.

(56) References Cited

U.S. PATENT DOCUMENTS

| | | | |
|---|---|---|---|
| 6,616,135 | B1 | 9/2003 | Shida et al. |
| 8,556,407 | B2 | 10/2013 | Toya et al. |
| 8,967,787 | B2 | 3/2015 | Toya et al. |
| 9,126,430 | B2 | 9/2015 | Liu |
| 9,186,915 | B2 | 11/2015 | Hasebe et al. |
| 10,399,364 | B2 | 9/2019 | Harada et al. |
| 2003/0234851 | A1 | 12/2003 | Booth et al. |
| 2007/0044924 | A1 | 3/2007 | Yoshie et al. |
| 2011/0050824 | A1 | 3/2011 | Toya et al. |

(Continued)

FOREIGN PATENT DOCUMENTS

| | | |
|---|---|---|
| DE | 10301895 | 8/2003 |
| EP | 1759871 | 3/2007 |

(Continued)

*Primary Examiner* — Leslie A Nicholson, III

(74) *Attorney, Agent, or Firm* — Workman Nydegger

(57) ABSTRACT

A first unit includes a receiving portion that receives a medium to be processed, a drying unit that processes the medium received from the receiving portion, and an end stitching unit that processes the medium received from the receiving portion or the medium processed by the drying unit. The processing performed by the drying unit is processing of drying the medium, the drying unit is located vertically below the end stitching unit, and the drying unit and the end stitching unit have a portion overlapping when viewed in a vertical direction.

16 Claims, 12 Drawing Sheets

(56) References Cited

U.S. PATENT DOCUMENTS

| | | | |
|---|---|---|---|
| 2012/0249704 | A1 | 10/2012 | Kato et al. |
| 2013/0009599 | A1 | 1/2013 | Yukizane et al. |
| 2013/0188000 | A1 | 7/2013 | Kitagishi |
| 2013/0242017 | A1 | 9/2013 | Toya et al. |
| 2014/0009548 | A1 | 1/2014 | Toya et al. |
| 2017/0072708 | A1 | 3/2017 | Miyashita et al. |
| 2019/0193425 | A1 | 6/2019 | Kubo |

FOREIGN PATENT DOCUMENTS

| | | |
|---|---|---|
| EP | 2295252 | 3/2011 |
| JP | 2010006530 | 1/2010 |
| JP | 2012148902 | 8/2012 |
| JP | 2012210758 | 11/2012 |

MEDIUM PROCESSING APPARATUS AND RECORDING SYSTEM

The present application is a continuation of U.S. patent application Ser. No. 16/721,161, filed Dec. 19, 2019, which claims priority to JP Patent Application No. 2018-240142, filed Dec. 21, 2018, the disclosures of which are hereby incorporated by reference herein in their entireties.

BACKGROUND

1. Technical Field

The present disclosure relates to a medium processing apparatus that processes a medium, and a recording system including the medium processing apparatus.

2. Related Art

In a medium processing apparatus that performs processing, such as stapling processing and punching processing, on a medium, for example, transported mediums are sent to a loading tray and ends of the mediums are aligned with each other in the loading tray. Thereafter, the processing such as the stapling processing and the punching processing is performed thereon. Further, such a medium processing apparatus may be provided adjacent to a recording apparatus represented by a printer and may constitute a recording system as a whole. Then, an example of such a configuration is shown in JP-A-2010-6530.

In the above-described recording system, when the recording apparatus is an ink jet printer that performs recording by ejecting ink to a medium, a unique problem occurs. That is, there is a problem in that, in the medium on which the recording is performed by ejecting the ink, since friction of an ejection surface to which the ink is ejected becomes high, for example, when the medium processing apparatus performs the processing, the integrity of the medium in the loading tray deteriorates. Then, in order to cope with this problem, it is preferable to accelerate drying of the medium by a drying mechanism before the medium is sent to the loading tray. However, the size of the drying mechanism is easy to increase, and when such a drying mechanism is provided inside the medium processing apparatus, the size of the medium processing apparatus increases. In particular, an occupied area in a horizontal direction increases.

SUMMARY

A medium processing apparatus of the present disclosure, which solves the above-described problem, includes a receiving portion that receives a medium to be processed, a first processing unit that performs first processing on the medium received from the receiving portion, and a second processing unit that performs second processing on the medium received from the receiving portion or the medium processed by the first processing unit, in which the processing performed by the first processing unit is processing of drying the medium, the first processing unit is located vertically below the second processing unit, and the first processing unit and the second processing unit have a portion overlapping when viewed in a vertical direction.

DESCRIPTION OF EXEMPLARY EMBODIMENTS

Figure 1:
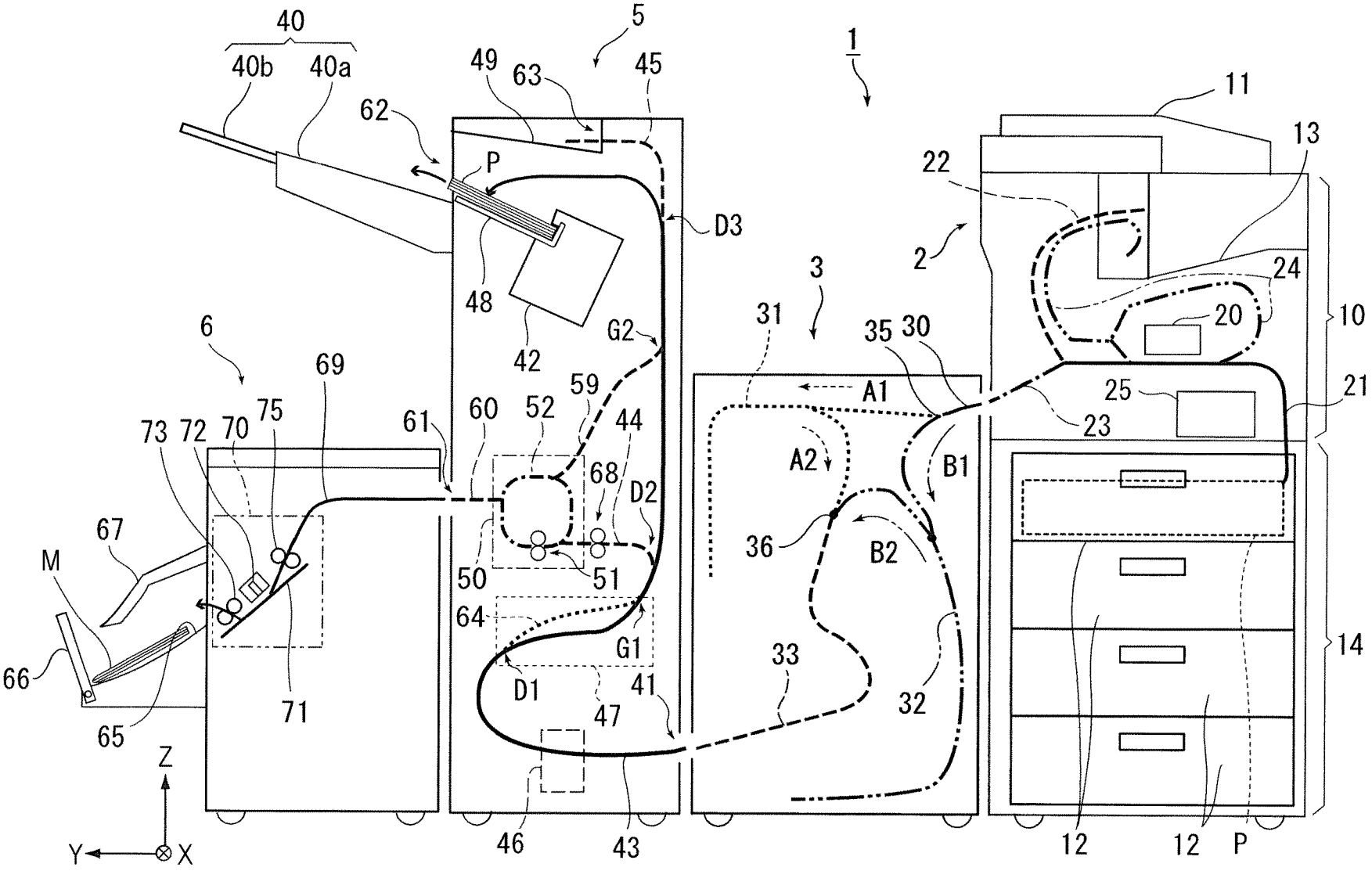
FIG. 1 is a schematic view of a recording system.

Hereinafter, the present disclosure will be schematically described.

A medium processing apparatus according to a first aspect includes a receiving portion that receives one or more media to be processed, a first processing unit that performs first processing on the media received from the receiving portion, and a second processing unit that performs second processing on the media received from the receiving portion and not subjected to the first processing or the media received from the receiving portion and subjected to the first processing, in which the processing performed by the first processing unit is processing of drying the media, and the first processing unit is located vertically below the second processing unit, and the first processing unit has a portion overlapping with the second processing unit when viewed in a vertical direction.

According to this aspect, in the configuration in which the first processing unit and the second processing unit are included, the processing performed by the first processing unit is processing of drying the media, the first processing unit is located vertically below the second processing unit, and the first processing unit and the second processing unit have a portion overlapping when viewed in the vertical direction. Thus, an increase in the horizontal dimension of the apparatus can be suppressed, and miniaturization of the apparatus can be realized.

A second aspect of the present disclosure provides the medium processing apparatus according to the first aspect, in which the processing performed by the second processing unit is end stitching processing of stitching ends of the media.

According to this aspect, in the configuration in which the processing performed by the second processing unit is stitching processing of stitching the ends of the media, the above-described operation and effect of the first aspect can be obtained.

A third aspect of the present disclosure provides the medium processing apparatus according to the first aspect or the second aspect, which further includes a stacking processing unit that stacks a plurality of the media received from the receiving portion and sends the plurality of the media to the first processing unit or the second processing unit, in which the stacking processing unit is located vertically below the first processing unit, and the first processing unit has a portion overlapping with the second processing unit and the stacking processing unit when viewed in the vertical direction.

According to this aspect, in the configuration in which the stacking processing unit is included in addition to the first processing unit and the second processing unit, the stacking processing unit is located vertically below the first processing unit, and the first processing unit has an overlapping portion with the second processing unit and the stacking processing unit when viewed in the vertical direction. Thus, the increase in the horizontal dimension of the apparatus can be suppressed, and the miniaturization of the apparatus can be realized.

A fourth embodiment of the present disclosure provides the medium processing apparatus according to the first aspect or the second aspect, which further includes a punching processing unit that performs punching processing on the media received from the receiving portion, in which the punching processing unit is located vertically below the first processing unit, and the first processing unit has a portion overlapping with the second processing unit and the punching processing unit when viewed in the vertical direction.

According to this aspect, in the configuration in which the punching processing unit is included in addition to the first processing unit and the second processing unit, the punching processing unit is located vertically below the first processing unit, and the first processing unit has an overlapping portion with the second processing unit and the punching processing unit when viewed in the vertical direction. Thus, the increase in the horizontal dimension of the apparatus can be suppressed, and the miniaturization of the apparatus can be realized.

A fifth aspect of the present disclosure provides the medium processing apparatus according to any one of the first to fourth aspects, which further includes a saddle stitching processing unit that stitches central portions of the media received from the receiving portion in a medium transport direction, in which the saddle stitching processing unit is located vertically below the first processing unit, and the first processing unit has a portion overlapping with the second processing unit and the saddle stitching processing unit when viewed in the vertical direction.

According to this aspect, in the configuration in which the saddle stitching processing unit is included in addition to the first processing unit and the second processing unit, the saddle stitching processing unit is located vertically below the first processing unit, and the first processing unit has an overlapping portion with the second processing unit and the saddle stitching processing unit when viewed in the vertical direction. Thus, the increase in the horizontal dimension of the apparatus can be suppressed, and the miniaturization of the apparatus can be realized.

A sixth aspect of the present disclosure provides the medium processing apparatus according to any one of the first to fourth aspects, which further includes a saddle stitching processing unit that stitches central portions of the media received from the receiving portion in a medium transport direction, in which the saddle stitching processing unit is located between the first processing unit and the second processing unit in the vertical direction, and the first processing unit has a portion overlapping with the second processing unit and the saddle stitching processing unit when viewed in the vertical direction.

According to this aspect, in the configuration in which the saddle stitching processing unit is included in addition to the first processing unit and the second processing unit, the saddle stitching processing unit is located between the first processing unit and the second processing unit in the vertical direction, and the first processing unit has an overlapping portion with the second processing unit and the saddle stitching processing unit when viewed in the vertical direction. Thus, the increase in the horizontal dimension of the apparatus can be suppressed, and the miniaturization of the apparatus can be realized.

A seventh aspect of the present disclosure provides the medium processing apparatus according to any one of the first to fourth aspects, which further includes a first discharge section that discharges the media processed by the first processing unit to an outside of the medium processing apparatus, a second discharge section that discharges the media processed by the second processing unit to the outside of the medium processing apparatus, and a tray that receives the media discharged from the second discharge section, in which a saddle stitching unit that is provided outside the medium processing apparatus, receives the media discharged from the first discharge section, and performs saddle stitching processing of stitching central portions of the media in a medium discharge direction is configured to be attachable to and detachable from the medium processing apparatus below the tray.

According to this aspect, since the saddle stitching unit is configured to be detachable from the medium processing apparatus below the tray, it is possible to easily switch between a configuration having the saddle stitching unit and a configuration not having the saddle stitching unit.

Further, when the saddle stitching unit is mounted, the saddle stitching unit is located below the tray. Thus, removal of the media discharged to the tray is not hindered by the saddle stitching unit.

An eighth aspect of the present disclosure provides the medium processing apparatus according to any one of the first to seventh aspects, in which the first processing unit includes a drying processing unit that performs drying processing on the media, and a loop-like transport path including the drying processing unit and configured to circumferentially transport the media.

According to this aspect, since the first processing unit includes the loop-like transport path including the drying processing unit and configured to circumferentially transport the media, by circumferentially transporting the media, the drying processing by the drying processing unit can be performed a plurality of times, and more reliable drying can be performed. Further, it is possible to suppress an increase in the size of the apparatus without increasing the size of the transport path for performing the drying processing a plurality of times.

A ninth aspect of the present disclosure provides the medium processing apparatus according to the eighth aspect, which further includes a first switching member that switches to a first state in which the media processed by the first processing unit are sent to the first discharge section, and a second switching member that switches to a second state in which the media processed by the first processing unit are sent to the second processing unit.

According to this aspect, since the switching members that can switch between the first state in which the media processed by the first processing unit are sent to the first discharge section and the second state in which the media processed by the first processing unit are sent to the second processing unit are included, the drying processing can be performed both when the media are sent to the saddle stitching unit and when the media are sent to the second processing unit.

A tenth aspect of the present disclosure provides the medium processing apparatus according to the ninth aspect, in which the loop-like transport path is accommodated within an area of the second processing unit when viewed in a horizontal direction.

According to this aspect, since the loop-like transport path is accommodated within the area of the second processing unit when viewed in the horizontal direction, the increase in the horizontal dimension of the apparatus can be effectively suppressed, and the miniaturization of the apparatus can be realized.

A recording system according to an eleventh aspect includes a recording unit that includes a recording section performing recording on a medium, and the medium processing apparatus according to any one of the first to tenth aspects, which processes the medium after the recording by the recording section.

According to this aspect, in the recording system, the operation and effect of any one of the first aspect to the tenth aspect described above can be obtained.

A recording system includes a recording unit that includes a recording section performing recording on a medium, the medium processing apparatus according to any one of the first to tenth aspects, which processes the medium after the recording by the recording section, and a saddle stitching unit that is provided outside the medium processing apparatus, receives the medium discharged from the medium processing apparatus, and performs saddle stitching processing of stitching a central portion of the medium in a medium discharge direction.

First Embodiment

Hereinafter, a first embodiment will be described with reference to the drawings. In an XYZ coordinate system shown in each drawing, an X axis direction indicates the depth direction of an apparatus, a Y axis direction indicates the width direction of the apparatus, and a Z axis direction indicates the height direction of the apparatus.

Outline of Recording System

A recording system 1 illustrated in FIG. 1 includes, for example, a recording unit 2, an intermediate unit 3, a first unit 5 as the medium processing apparatus, and a second unit 6 as a saddle stitching unit that is detachably attached to the first unit 5, in an order from the right side to the left side of FIG. 1.

The first unit 5 is provided with a drying unit 50 that performs drying processing on a received medium and an end stitching unit 42 that performs end stitching processing of bundling media on which recording has been performed by the recording unit 2 and stitching ends of the media. In the first unit 5, the drying unit 50 is a first processing unit, and the end stitching unit 42 is a second processing unit. The second unit 6 is provided with a saddle stitching processing unit 70 that performs saddle stitching processing of stitching and folding a central portion of a bundle of the media on which recording has been performed by the recording unit 2 to make a booklet.

The recording system 1 can be configured not to include the second unit 6 and not to perform the saddle stitching processing as post-processing that is performed on the media on which recording has been performed by the recording unit 2. Further, illustration of the recording system 1 from which the second unit 6 is removed will be omitted.

The recording unit 2 performs recording on a transported medium. The intermediate unit 3 receives the medium, on which recording has been performed, from the recording unit 2 to send the medium to the first unit 5. The first unit 5 performs processing, such as the drying processing and the end stitching processing, on the received medium. The first unit 5 can transmit the medium after the drying processing to the second unit 6. The second unit 6 performs the saddle stitching processing.

Hereinafter, the recording unit 2, the intermediate unit 3, the first unit 5 (the medium processing apparatus), and the second unit 6 will be described in detail in the order thereof.

Regarding Recording Unit

The recording unit 2 will be described with reference to FIG. 1. The recording unit 2 is configured as a multifunction device including a printer unit 10 having a line head 20 as a recording section for performing recording on the medium and a scanner unit 11. In the present embodiment, the line head 20 is configured as a so-called ink jet recording head that performs recording by ejecting ink, which is liquid, onto the medium.

A cassette accommodating unit 14 including a plurality of medium accommodating cassettes 12 is provided below the printer unit 10. A medium P accommodated in the medium accommodating cassette 12 is sent to a recording area through a feeding path 21 illustrated by a solid line of FIG. 1, and a recording operation is performed on the medium P by the line head 20. The medium on which recording has been performed by the line head 20 is sent to any one of a first discharge path 22 that is a path for discharging the medium to a post-recording discharge tray 13 provided above the line head 20 and a second discharge path 23 that is a path for sending the medium to the intermediate unit 3.

In FIG. 1, the first discharge path 22 is indicated by a broken line, and the second discharge path 23 is indicated by a one-dot chain line. The second discharge path 23 extends in a +Y direction of the recording unit 2, and delivers the medium to a reception path 30 of the adjacent intermediate unit 3.

Further, the recording unit 2 includes a reversing path 24 indicated by a two-dot chain line of FIG. 1, and is configured to be capable of double-sided recording in which after recording is performed on a first surface of the medium, the medium is reversed, and recording is performed on a second surface of the medium. Further, in each of the feeding path 21, the first discharge path 22, the second discharge path 23, and the reversing path 24, for example, one or more roller pairs (not illustrated) are disposed as a unit for transporting the medium.

The recording unit 2 is provided with a control unit 25 that controls an operation related to the transport and the recording of the medium in the recording unit 2. Further, the recording system 1 is configured such that the recording unit 2, the intermediate unit 3, the first unit 5, and the second unit 6 are mechanically and electrically coupled to each other, and the medium can be transported from the recording unit 2 to the second unit 6. The control unit 25 can control various operations of the intermediate unit 3, the first unit 5, and the second unit 6 which are coupled to the recording unit 2.

The recording system 1 is configured such that settings of the recording unit 2, the intermediate unit 3, the first unit 5, and the second unit 6 can be input from an operation panel which is not illustrated. The operation panel may be provided in, for example, the recording unit 2.

Regarding Intermediate Unit

The intermediate unit 3 will be described with reference to FIG. 1. The intermediate unit 3 illustrated in FIG. 1 delivers the medium received from the recording unit 2 to the first unit 5. The intermediate unit 3 is disposed between the recording unit 2 and the first unit 5. The medium transported through the second discharge path 23 of the recording unit 2 is received by the intermediate unit 3 from the reception path 30, and is transported to the first unit 5. Further, the reception path 30 is illustrated by a solid line of FIG. 1.

In the intermediate unit 3, there are two transport paths through which the medium is transported. A first transport path is a path through which the medium is transported from the reception path 30 via a first switchback path 31 illustrated by a dotted line of FIG. 1 to a joining path 33. A second path is a path through which the medium is transported from the reception path 30 via a second switchback path 32 illustrated by a two-dot chain line of FIG. 1 to the joining path 33.

The first switchback path 31 is a path through which the medium is received in a direction of an arrow A1 and is then switched back in a direction of an arrow A2. The second switchback path 32 is a path through which the medium is received in a direction of an arrow B1 and is then switched back in a direction of an arrow B2.

The reception path 30 branches into the first switchback path 31 and the second switchback path 32 at a branching portion 35. The branching portion 35 is provided with a flap that is not illustrated and switches destination of the medium to either the first switchback path 31 or the second switchback path 32.

Further, the first switchback path 31 and the second switchback path 32 are joined at a junction portion 36. Accordingly, even when the medium is sent from the reception path 30 to either the first switchback path 31 or the second switchback path 32, the medium can be delivered to the first unit 5 through the common joining path 33.

The intermediate unit 3 receives the medium from the recording unit 2 into the reception path 30 in a state where the surface on which the latest recording is performed by the line head 20 is headed to the upper side. However, the medium is bent and reversed, and thus the latest recording surface is headed to the lower side in the joining path 33.

Thus, the medium in a state in which the latest recording surface is headed to the lower side is delivered from the +Y direction of the intermediate unit 3 to a first transport path 43 of the first unit 5.

Further, in each of the reception path 30, the first switchback path 31, the second switchback path 32, and the joining path 33, for example, one or more roller pairs that are not illustrated are arranged as a unit for transporting the medium.

When recording is continuously performed on a plurality of media in the recording unit 2, the medium that has entered the intermediate unit 3 is alternately sent to a transport path passing through the first switchback path 31 and a transport path passing through the second switchback path 32. This can increase a throughput of medium transport in the intermediate unit 3.

Further, in a case where the recording is performed by ejecting the ink (the liquid) to the medium as in the line head 20 of the present embodiment, when the processing is performed by the first unit 5 or the second unit 6 in a subsequent stage, if the medium is wet, the recording surface may be rubbed and the integrity of the medium may be poor.

By delivering the medium, on which recording has been performed, from the recording unit 2 via the intermediate unit 3 to the first unit 5, a transport time required for the medium on which recording has been performed to be sent to the first unit 5 can be made long, and the medium can be further dried by the time the medium reaches the first unit 5 or the second unit 6.

Regarding First Unit

Subsequently, the first unit 5 (the medium processing apparatus) will be described. The first unit 5 illustrated in FIG. 1 includes a receiving portion 41 that receives the medium from the intermediate unit 3 on the lower side in a −Y direction. The medium transported along the joining path 33 of the intermediate unit 3 is input into the first unit 5 from the receiving portion 41 and is delivered to the first transport path 43.

The first unit 5 includes the drying unit 50 as the first processing unit that processes the medium received from the receiving portion 41 and the end stitching unit 42 as the second processing unit that processes the medium received from the receiving portion 41 or the medium processed by the drying unit 50.

The first unit 5 includes the first transport path 43 through which the medium received from the receiving portion 41 is sent to the end stitching unit 42 and a second transport path 44 which branches from the first transport path 43 at a second branching portion D2 and through which the medium is sent to the drying unit 50. The second branching portion D2 is provided with a flap that is not illustrated and switches a destination of the medium between the first transport path 43 and the second transport path 44.

For example, the end stitching unit 42 is a component that performs the end stitching processing of stitching the end of the medium, such as one corner of the medium and one side of the medium. For example, the end stitching unit 42 includes a stapler.

The drying unit 50 is a component that performs the drying processing on the medium. In the present embodiment, the drying unit 50 dries the medium by heating the medium. Although a detailed configuration of the drying unit 50 will be described later, the medium drying-processed by the drying unit 50 is sent to either the end stitching unit 42 or the saddle stitching processing unit 70 provided in the second unit 6.

Figure 2:
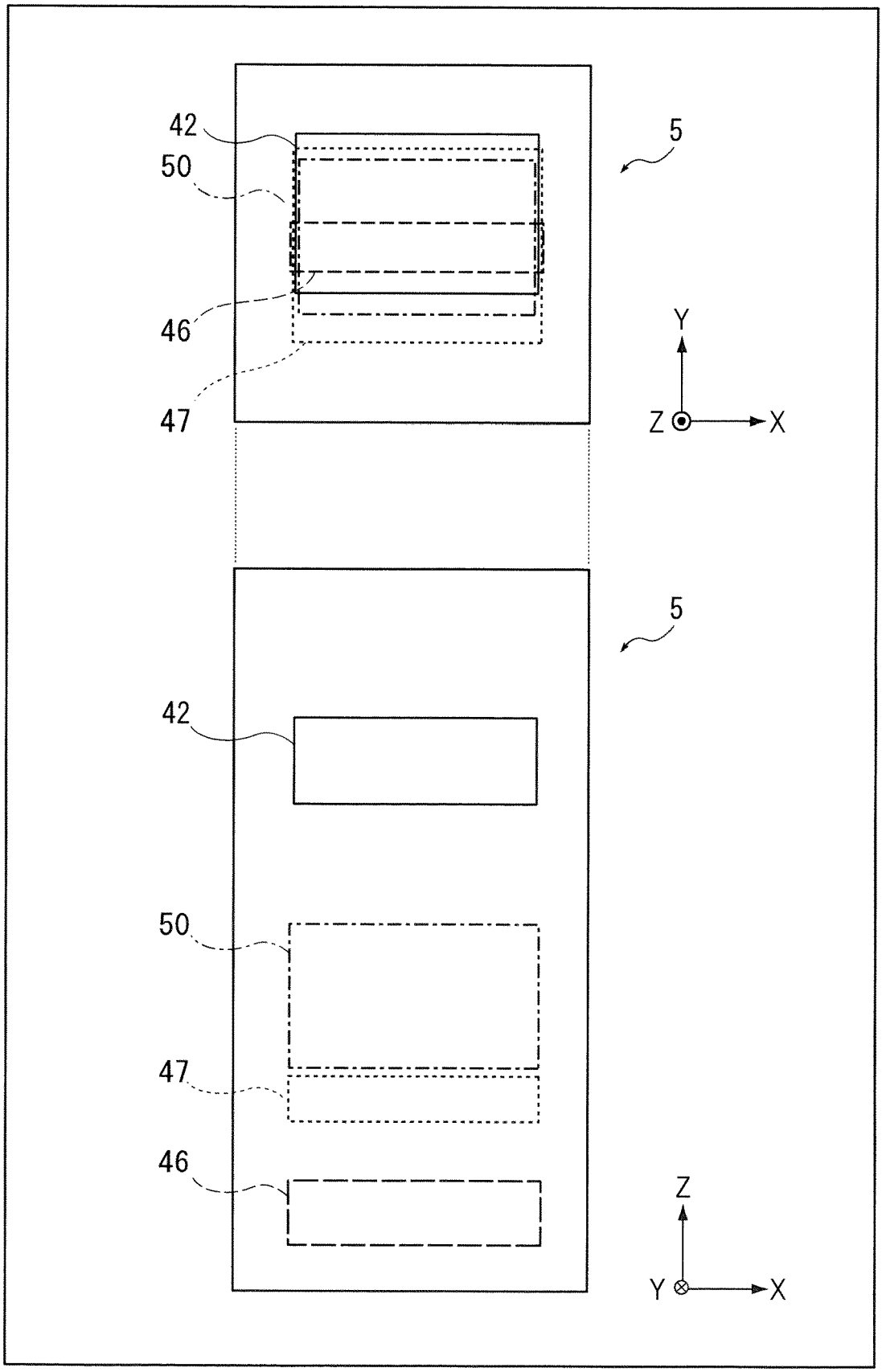
FIG. 2 is a diagram for illustrating arrangement of an end stitching unit, a drying unit, a stacking processing unit, and a punching processing unit of a first unit.

Here, in the first unit 5 according to the present embodiment, as illustrated in FIG. 1 and a lower view of FIG. 2, the drying unit 50 as the first processing unit is located in a −Z direction that is a vertically downward direction of the end stitching unit 42 as the second processing unit. As illustrated in an upper view of FIG. 2, the drying unit 50 and the end stitching unit 42 have an overlapping portion when viewed in a vertical direction, that is, when viewed in an upper side. Further, the upper view of FIG. 2 is a schematic view when the first unit 5 is viewed in a −Z direction, that is, when the first unit 5 is viewed in an upper side. The lower view of FIG. 2 is a schematic view when the first unit 5 is viewed in a +Y direction.

The drying unit 50 (the first processing unit) and the end stitching unit 42 (the second processing unit) are arranged in such a positional relationship, so that an increase in a horizontal dimension of the first unit 5 can be suppressed, and the apparatus can be miniaturized.

Further, as illustrated in FIG. 1, the first unit 5 includes a punching processing unit 46 that performs punching processing on the medium received from the receiving portion 41. The punching processing unit 46 is installed at a position, close to the receiving portion 41, of the first transport path 43 through which the medium received by the first unit 5 passes, and is configured to be able to perform the punching processing upstream of the first transport path 43.

Then, as illustrated in FIG. 1 and the lower view of FIG. 2, the punching processing unit 46 is located vertically below the drying unit 50. As illustrated in the upper view of FIG. 2, the drying unit 50, the end stitching unit 42, and the punching processing unit 46 have an overlapping portion when viewed in a vertical direction, that is, when viewed in an upper side.

Alternatively, only the drying unit 50 and the punching processing unit 46 may overlap each other, or only the end stitching unit 42 and the punching processing unit 46 may overlap each other.

By arranging the drying unit 50, the end stitching unit 42, and the punching processing unit 46 in such a positional relationship, an increase in the horizontal dimension of the apparatus can be suppressed, and miniaturization of the apparatus can be realized.

The medium received from the receiving portion 41 can be sent to a processing tray 48 through the first transport path 43 illustrated in FIG. 1. The medium sent to the processing tray 48 may or may not have been punched by the punching processing unit 46. In the processing tray 48, the media are stacked on the processing tray 48 while rear ends of the media in a transport direction are aligned with each other. When a predetermined number of media P are stacked on the processing tray 48, the end stitching processing by the end stitching unit 42 is performed at rear ends of the media P. The first unit 5 includes a second discharge section 62 that discharges the medium in the +Y direction. Further, the first unit 5 includes a first discharge section 61 and a third discharge section 63, which will be described below, in addition to the second discharge section 62, and is configured to discharge the medium from these sections.

The medium processed by the end stitching unit 42 (the second processing unit) is discharged from the second discharge section 62 to the outside of the medium processing apparatus of the first unit 5 by a discharge unit which is not illustrated, and is placed on a first tray 40 as a tray that receives the medium discharged from the second discharge section 62. The first tray 40 is provided to protrude from the first unit 5 in the +Y direction. In the present embodiment, the first tray 40 includes a base portion 40*a* and an extension portion 40*b*, and the extension portion 40*b* is configured to be accommodatable in the base portion 40*a*.

Further, a third transport path 45 branching from the first transport path 43 at a third branching portion D3 downstream of the second branching portion D2 is coupled to the first transport path 43. The third branching portion D3 is provided with a flap that is not illustrated and switches a destination of the medium between the first transport path 43 and the third transport path 45.

An upper tray 49 is provided at an upper portion of the first unit 5. The third transport path 45 extends from the third branching portion D3 to the third discharge section 63 described above, and the medium transported through the third transport path 45 is discharged from the third discharge section 63 to the upper tray 49 by a discharge unit which is not illustrated. The medium punching-processed by the punching processing unit 46 can be placed on the upper tray 49. Further, the medium on which no punching processing is performed and no processing is performed after the recording can be stacked.

The first transport path 43 is provided with an overlapping path 64 which branches from the first transport path 43 at a first branching portion D1 and is rejoined to the first transport path 43 at a first junction portion G1. The overlapping path 64 constitutes a stacking processing unit 47 that stacks two sheets of the media and sends the two media to the drying unit 50 or the end stitching unit 42. A leading medium transported in advance is sent to the overlapping path 64, and a trailing medium transported through the first transport path 43 are joined at the first junction portion G1, so that the leading medium and the trailing medium can be transported downstream of the first junction portion G1 while overlapping each other. Further, the stacking processing unit 47 may be configured to provide a plurality of overlapping paths 64 and to send three or more sheets of the media to the downstream while the media overlap each other.

In the first unit 5, while the stacking processing unit 47 is located vertically below the drying unit 50, the drying unit 50, the end stitching unit 42, and the stacking processing unit 47 have an overlapping portion when viewed in a vertical direction, that is, when viewed in an upper surface. Alternatively, only the drying unit 50 and the stacking processing unit 47 may overlap each other, or only the end stitching unit 42 and the stacking processing unit 47 may overlap each other.

Since the drying unit 50 (the first processing unit), the end stitching unit 42 (the second processing unit), and the stacking processing unit 47 are arranged in such a positional relationship, the increase in the horizontal direction of the apparatus can be suppressed, and the miniaturization of the apparatus can be realized.

Further, in the first unit 5, for example, one or more roller pairs, which are not illustrated, as a unit that transports the medium are arranged in each of the first transport path 43, the second transport path 44, and the third transport path 45.

Regarding Drying Unit

Next, the drying unit 50 as the first processing unit will be described mainly with reference to FIG. 3.

Figure 3:
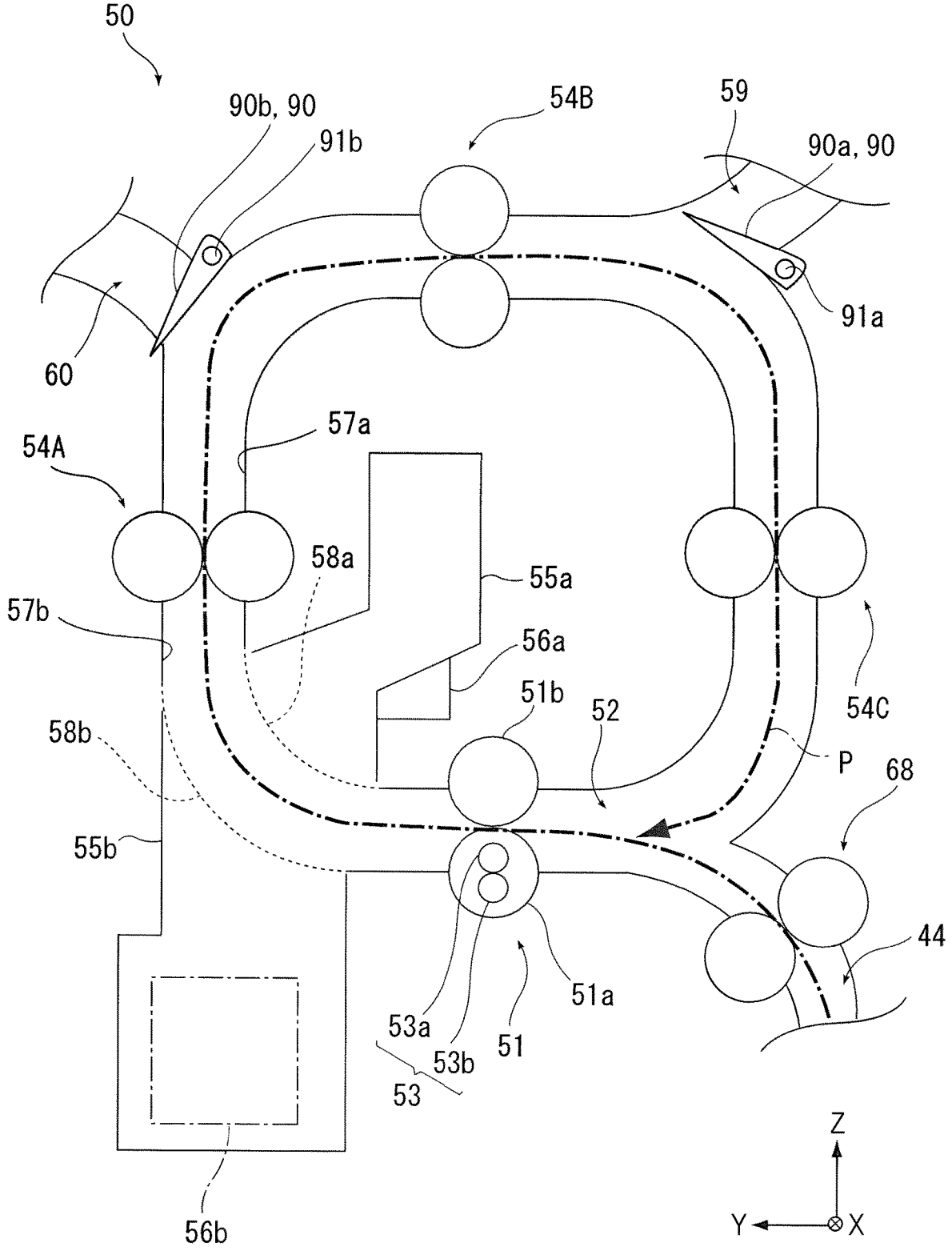
FIG. 3 is a schematic side view of the drying unit.

As illustrated in FIG. 3, the drying unit 50 includes a heat roller pair 51 as a drying processing unit that performs the drying processing of the medium and a loop-like transport path 52 that includes the heat roller pair 51 and can circumferentially transport the medium. The loop-like transport path 52 is formed with an inner path forming portion 57*a* and an outer path forming portion 57*b*, and the medium is transported through a space between the inner path forming portion 57*a* and the outer path forming portion 57*b*. The second transport path 44 branching from the first transport path 43 (FIG. 1) is joined to the loop-like transport path 52 upstream of the heat roller pair 51. Thus, the medium can be sent by a transport roller pair 68 provided in the second transport path 44 and can be introduced into the loop-like transport path 52.

The heat roller pair 51 is a roller pair that holds the medium by a drying driving roller 51*a* driven by a driving source which is not illustrated and a drying driven roller 51*b* driven to rotate by rotation of the drying driving roller 51*a*.

In the present embodiment, the drying driving roller 51*a* is configured to be heated.

The drying driving roller 51*a* may include, for example, an induction coil 53 therein and can be heated by an induction heating method of heating a roller by action of a magnetic field generated by causing a current to flow to the induction coil 53. Further, instead of the induction heating method, for example, a halogen lamp can also be used as a heat source. The drying driving roller 51*a* is made of, for example, a metal material having high thermal conductivity.

Further, the drying driven roller 51*b* is formed of an elastic material such as a sponge formed of a resin material.

The heating temperature of the drying driving roller 51*a* can be adjusted by turning on and off heating by the induction coil 53. Further, for example, the temperature can be adjusted by controlling a duty ratio of the current flowing to the induction coil 53. Further, the drying unit 50 can be provided with a temperature detection unit that is not illustrated and detects the temperature of the drying driving roller 51*a*.

In the present embodiment, two of a first induction coil 53*a* and a second induction coil 53*b* are provided as the induction coil 53.

Figure 4:
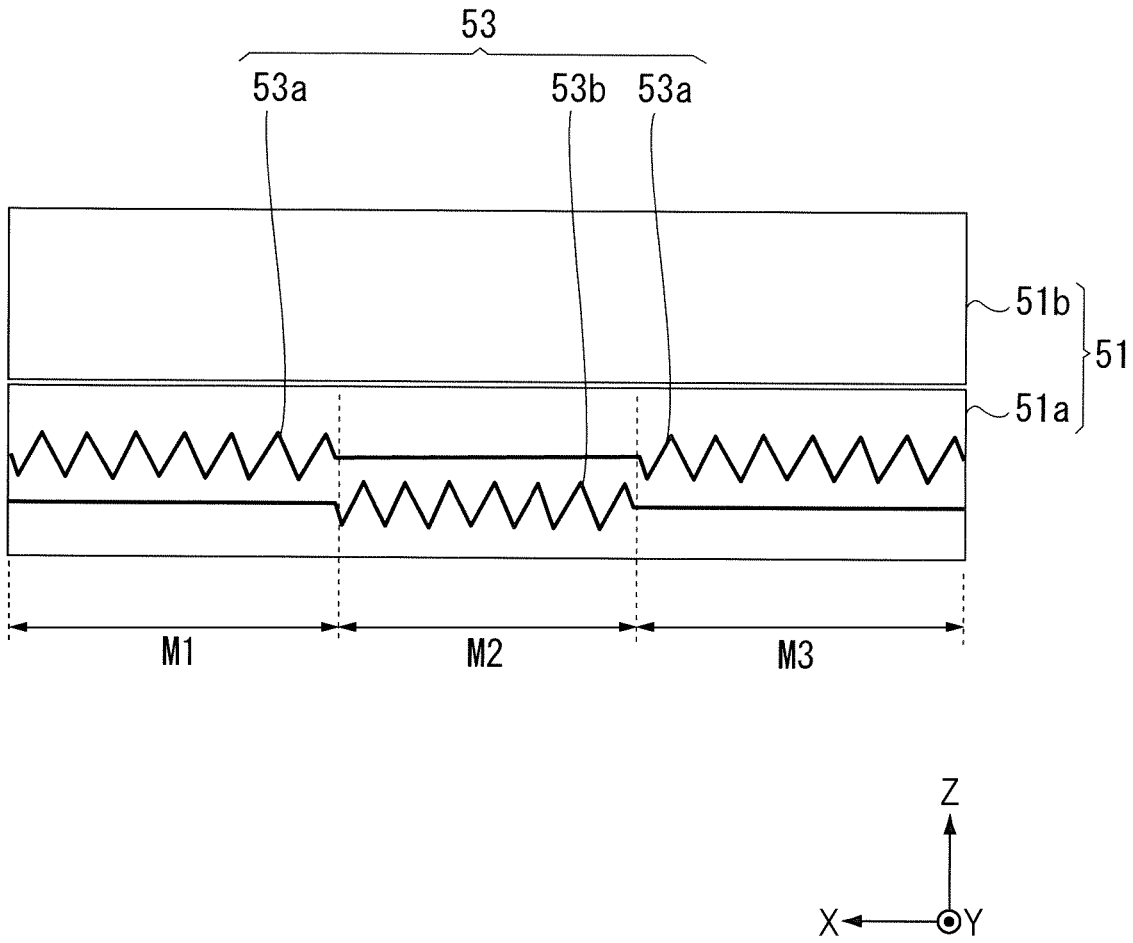
FIG. 4 is a diagram for illustrating a configuration of a heat roller pair.

As illustrated in FIG. 4, the first induction coil 53*a* and the second induction coil 53*b* are disposed offset from each other in the X axis direction, which is the width direction of the medium. Accordingly, the heating area of the drying driving roller 51*a* is divided into a plurality of parts in the X axis direction.

The first induction coil 53*a* heats end areas M1 and M3 of the drying driving roller 51*a* in a medium width direction, and the second induction coil 53*b* heats an intermediate area M2 of the drying driving roller 51*a* in the medium width direction. With this configuration, the end areas M1 and M3 and the intermediate area M2 can be heated individually, and the heating areas in the medium width direction can be switched.

Alternatively, three or more induction coils 53 having different heating areas in the medium width direction may be provided or the entire area in the medium width direction may be heated by one induction coil 53.

Further, as in the present embodiment, in the heat roller pair 51, at least one of the drying driving roller 51*a* and the drying driven roller 51*b* constituting the heat roller pair 51 may be heated or only the drying driven roller 51*b* may be heated.

Further, both the drying driving roller 51*a* and the drying driven roller 51*b* may be heated. When both the drying driving roller 51*a* and the drying driven roller 51*b* are heated, both surfaces of a paper sheet are heated, so that the paper sheet can be more certainly dried.

As described above, the medium sent from the intermediate unit 3 is input from the receiving portion 41 via the first transport path 43 to the second transport path 44 of the first unit 5 illustrated in FIG. 1 in a state in which the latest recording surface faces the lower side. Then, the medium is nipped by the heat roller pair 51 in a state in which the latest recording surface faces the lower side. Therefore, between the heat roller pair 51 illustrated in FIG. 3, the heated drying driving roller 51*a* comes into contact with the latest recording surface of the medium. That is, since the latest recording surface can be directly heated, the medium can be effectively dried.

The loop-like transport path 52 illustrated in FIG. 3 is provided with a first transport roller pair 54A, a second transport roller pair 54B, and a third transport roller pair 54C, through which the medium is transported, in addition to the heat roller pair 51. The loop-like transport path 52 is configured to transport the medium circumferentially. In FIG. 3, a one-dot chain line indicated by reference sign P indicates a trajectory of the medium which is input into the loop-like transport path 52 from the second transport path 44 to make one revolution.

With the loop-like transport path 52, by circumferentially transporting the medium a plurality of times, the drying processing by the heat roller pair 51 can be performed a plurality of times. Therefore, the medium can be dried more reliably.

Further, by providing the loop-like transport path 52, an increase in the size of the apparatus can be suppressed without increasing the size of the transport path for performing the drying processing a plurality of times, as compared to, for example, a case where a plurality of the heat roller pairs 51 are provided in the transport path.

In the recording system 1, the heating by the heat roller pair 51 is controlled by the control unit 25 (FIG. 1). The control unit 25 can control the heating by the heat roller pair 51 according to the conditions. The conditions include, for example, the amount of the ink ejected to the medium during the recording by the recording unit 2, whether the recording on the medium is the double-sided recording or the single-sided recording, the environmental conditions such as the temperature and the humidity during the drying, in addition to the type, the rigidity, the thickness, and the basis weight of the medium.

By controlling the heating by the heat roller pair 51 according to these conditions, the medium can be more properly dried. Control of the heating by the heat roller pair 51 includes, for example, whether the heating is performed, the temperature during the heating, whether or not to perform residual heat during the heating, a timing when the heating by the heat roller pair 51 starts.

Further, in the heat roller pair 51, the drying driven roller 51*b* is pressed against the drying driving roller 51*a* by a pressing unit, which is not illustrated, such as a spring, so that a pressing force by the pressing unit can be changed. When the control unit 25 controls a pressing force changing unit (not illustrated) that changes the pressure by the pressing unit, the nip pressure in the heat roller pair 51 can be adjusted. It is preferable that the nip pressure of the heat roller pair 51 is changed according to the conditions. The same conditions when the heating by the heat roller pair 51 is controlled can be used as the conditions.

A first duct 55*a* and a second duct 55*b* are provided downstream of the heat roller pair 51 and upstream of the first transport roller pair 54A. The first duct 55*a* is suctioned by a first fan 56*a*, and the second duct 55*b* is sucked by a second fan 56*b*.

Portions of the inner path forming portion 57*a* and the outer path forming portion 57*b*, corresponding to the first duct 55*a* and the second duct 55*b*, are formed by an inner suction portion 58*a* and an outer suction portion 58*b* having holes through which air of the loop-like transport path 52 passes, so that the air of the loop-like transport path 52 can be suctioned by each duct.

The inner suction portion 58*a* and the outer suction portion 58*b* can be formed, for example, in a vertical grid along a medium transport direction, can be provided with holes in a plate-like body, or can be formed in a mesh shape.

By providing the first duct 55*a* and the second duct 55*b*, it is possible to quickly discharge the vapor generated when the medium containing the ink (the liquid) is heated by the heat roller pair 51, to the outside of the apparatus.

A fourth transport path 59 is coupled to the loop-like transport path 52 illustrated in FIG. 3 downstream of the second transport roller pair 54B and upstream of the third transport roller pair 54C. The fourth transport path 59 is a path that is joined to the first transport path 43 at a second junction portion G2 and returns, to the first transport path 43, the medium drying-processed by the heat roller pair 51.

Further, a fifth transport path 60 is coupled to the loop-like transport path 52 downstream of the first transport roller pair 54A and upstream of the second transport roller pair 54B. The fifth transport path 60 is a path extending to the first discharge section 61 illustrated in FIG. 1 and is a path for feeding, toward the second unit 6, the medium drying-processed by the heat roller pair 51.

The first unit 5 includes a switching flap 90 (FIG. 3) as a switching member that is switchable between a first state in which the medium processed by the drying unit 50 is sent to the first discharge section 61 and a second state in which the medium processed by the drying unit 50 is sent to the end stitching unit 42.

In the present embodiment, the switching flap 90 includes two of a first switching flap 90*a* and a second switching flap 90*b*.

In more detail, in the loop-like transport path 52 illustrated in FIG. 3, the first switching flap 90*a* is provided at a coupling portion with the fourth transport path 59 and the second switching flap 90*b* is provided at a coupling portion with the fifth transport path 60.

The first switching flap 90*a* includes a first shaft portion 91*a* and is configured to be swingable about the first shaft portion 91*a*. The second switching flap 90*b* includes a second shaft portion 91*b* and is configured to be swingable about the second shaft portion 91*b*.

The first switching flap 90*a* and the second switching flap 90*b* are operated by a motor which is not illustrated or an electromagnetic clutch which is not illustrated, and the operation can be controlled by, for example, the control unit 25 provided in the recording unit 2.

When the medium is circumferentially transported around the loop-like transport path 52, as illustrated in FIG. 3, the first switching flap 90*a* and the second switching flap 90*b* are in a posture of closing the fourth transport path 59 and the fifth transport path 60, respectively. Hereinafter, a state of the switching flap 90 illustrated in FIG. 3 is referred to as a circumferential state.

Figure 5:
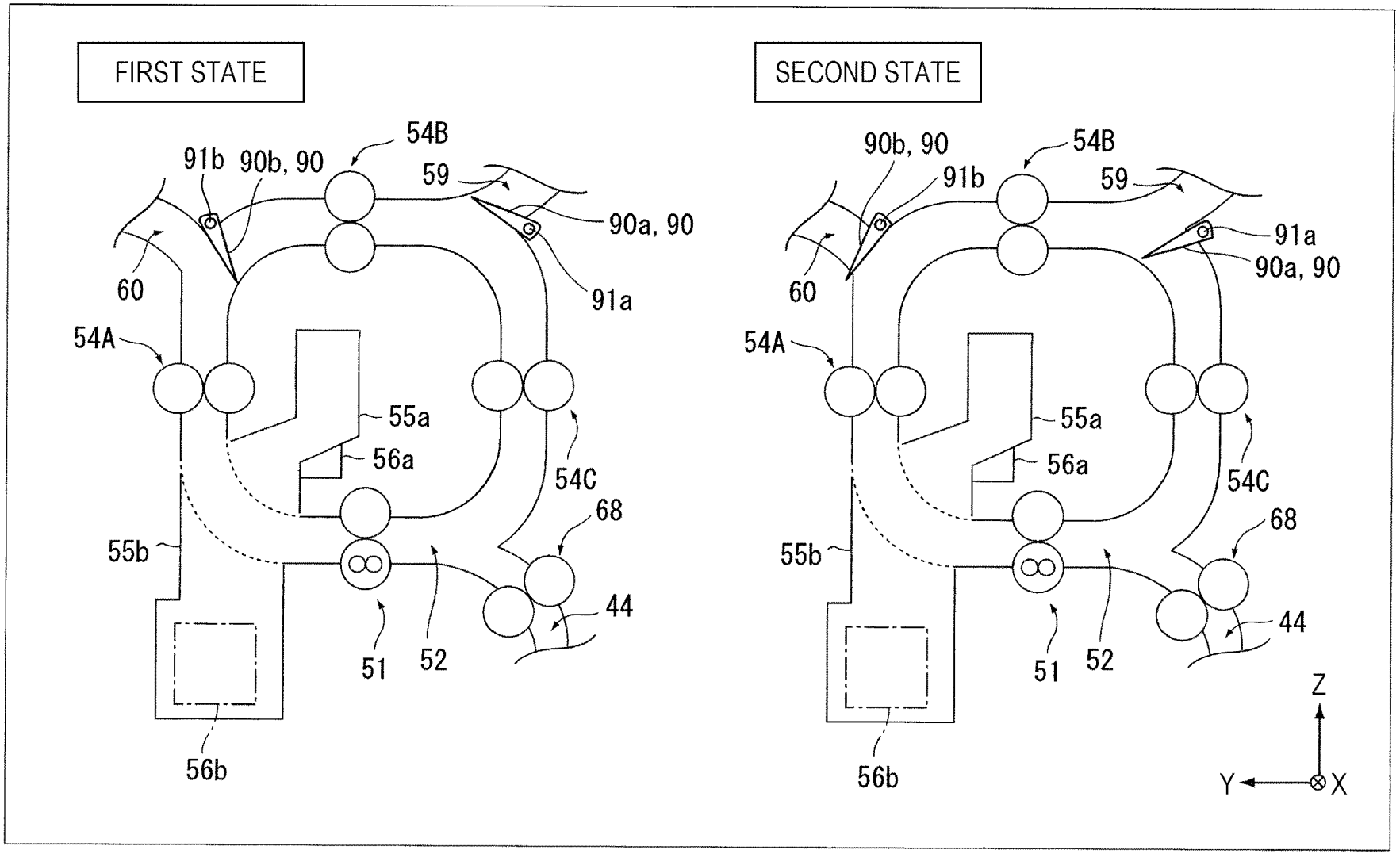
FIG. 5 is a diagram for illustrating an operation of a switching flap that switches between a first state in which the medium processed by the drying unit is sent to a first discharge section and a second state in which the medium processed by the drying unit is sent to an end stitching unit.

When the medium processed by the drying unit 50 is sent to the first discharge section 61, that is, when the medium is sent to the fifth transport path 60, the switching flap 90 is brought into the first state illustrated in a left view of FIG. 5 from the circumferential state of FIG. 3. In the first state, the second switching flap 90*b* swings to be in a posture of opening the fifth transport path 60 and closing the loop-like transport path 52. The first switching flap 90*a* remains in a posture of closing the fourth transport path 59.

By setting the switching flap 90 in the first state, the medium drying-processed through the heat roller pair 51 can be sent to the fifth transport path 60, and the medium can be delivered from the first discharge section 61 to the second unit 6.

When the medium processed by the drying unit 50 is sent to the end stitching unit 42, that is, when the medium is sent to the fourth transport path 59, the switching flap 90 is brought into the second state illustrated in a right view of FIG. 5 from the circumferential state of FIG. 3. In the second state, the first switching flap 90*a* swings to be in a posture of opening the fourth transport path 59 and closing the loop-like transport path 52. The second switching flap 90*b* remains in a posture of closing the fifth transport path 60.

By setting the switching flap 90 in the second state, the medium drying-processed by the heat roller pair 51 can be sent to the fourth transport path 59, and can be sent to the end stitching unit 42.

By providing the switching flap 90 as described above, the drying processing can be performed both when the medium is sent to the second unit 6 and when the medium is sent to the end stitching unit 42.

Further, as illustrated in FIG. 1, the loop-like transport path 52 is accommodated within an area of the end stitching unit 42 (the second processing unit) when viewed in a horizontal direction, that is, when viewed in a lateral surface. Although the loop-like transport path 52 is not described in the upper view and the lower view of FIG. 2, the length of the drying unit 50 in the X axis direction is substantially the same as the end stitching unit 42, and the loop-like transport path 52 is also accommodated within the area of the end stitching unit 42 also in the X axis direction.

Further, in the upper view of FIG. 2, in order to make the drawing easy to view, the end stitching unit 42, the drying unit 50, the stacking processing unit 47, and the punching processing unit 46 are described by slightly changing the lengths thereof in the X axis direction. However, since these lengths in the X axis direction are determined according to the width of the medium that can be transported in the first unit 5, the lengths may be actually the same length.

The loop-like transport path 52 is accommodated within the area of the end stitching unit 42 when viewed in a horizontal direction, so that the increase in the horizontal dimension of the apparatus can be effectively suppressed, and the miniaturization of the apparatus can be realized.

Alternatively, the drying unit 50 may be configured not to have the loop-like transport path 52.

Further, in the present embodiment, the drying unit 50 for drying the medium by heating the medium from the outside has been described. However, the drying unit 50 may also be configured to dry the medium, for example, by blowing air to the medium.

Further, in the present embodiment, an apparatus in which a recording function is omitted from the recording system 1 may be regarded as a medium processing apparatus.

Regarding Second Unit

The second unit 6 as a saddle stitching unit will be described with reference to FIG. 1.

The second unit 6 is provided outside the medium processing apparatus of the first unit 5, receives the medium discharged from the first discharge section 61, and performs the saddle stitching processing of stitching a central portion of the medium in the medium discharge direction (the +Y direction).

The medium delivered from the first discharge section 61 of the first unit 5 is transported through a transport path 69 illustrated by a solid line of FIG. 1, and is sent to the saddle stitching processing unit 70. The saddle stitching processing unit 70 can perform the saddle stitching processing of stitching the bundle M of the media and then folding the bundle M of the media at a stitched position to make a booklet. The saddle stitching processing by the saddle stitching processing unit 70 will be described in detail below.

The bundle M of the media, which has been saddle-stitching-processed by the saddle stitching processing unit 70, is discharged to a second tray 65 illustrated in FIG. 1. The second tray 65 includes a regulation unit 66 at a tip end in the +Y direction that is the medium discharge direction, and it is suppressed that the bundle M of the media discharged to the second tray 65 protrudes from the second tray 65 in the medium discharge direction or falls from the second tray 65. A guide portion 67 guides, to the second tray 65, the bundle M of the media discharged from the second unit 6.

In the present embodiment, the second unit 6 is configured to be detachable from the first unit 5 below the first tray 40.

With this configuration, it is possible to easily switch between a configuration having the second unit 6 and a configuration without the second unit 6 in the recording system 1 or the first unit 5 as the medium processing apparatus. Further, when the second unit 6 is mounted, the second unit 6 is located below the first tray 40. Thus, removal of the medium discharged to the first tray 40 is not prevented by the second unit 6.

Next, a configuration around the saddle stitching processing unit 70 will be described with reference to FIGS. 1 and 6. The second unit 6 illustrated in FIG. 1 is provided with a feeding roller pair 75 as a feeding unit provided in the transport path 69 to transport the medium P, a stacking unit 71 on which the medium P is stacked, and the saddle stitching processing unit 70 that performs the saddle stitching processing on the medium stacked on the stacking unit 71. The saddle stitching processing unit 70 includes a stitching unit 72 that stitches the bundle M of the media including a plurality of sheets of media P stacked on the stacking unit 71 at the stitched position and a folding roller pair 73 as a folding unit that folds the bundle M of the media at the stitched position.

Figure 6:
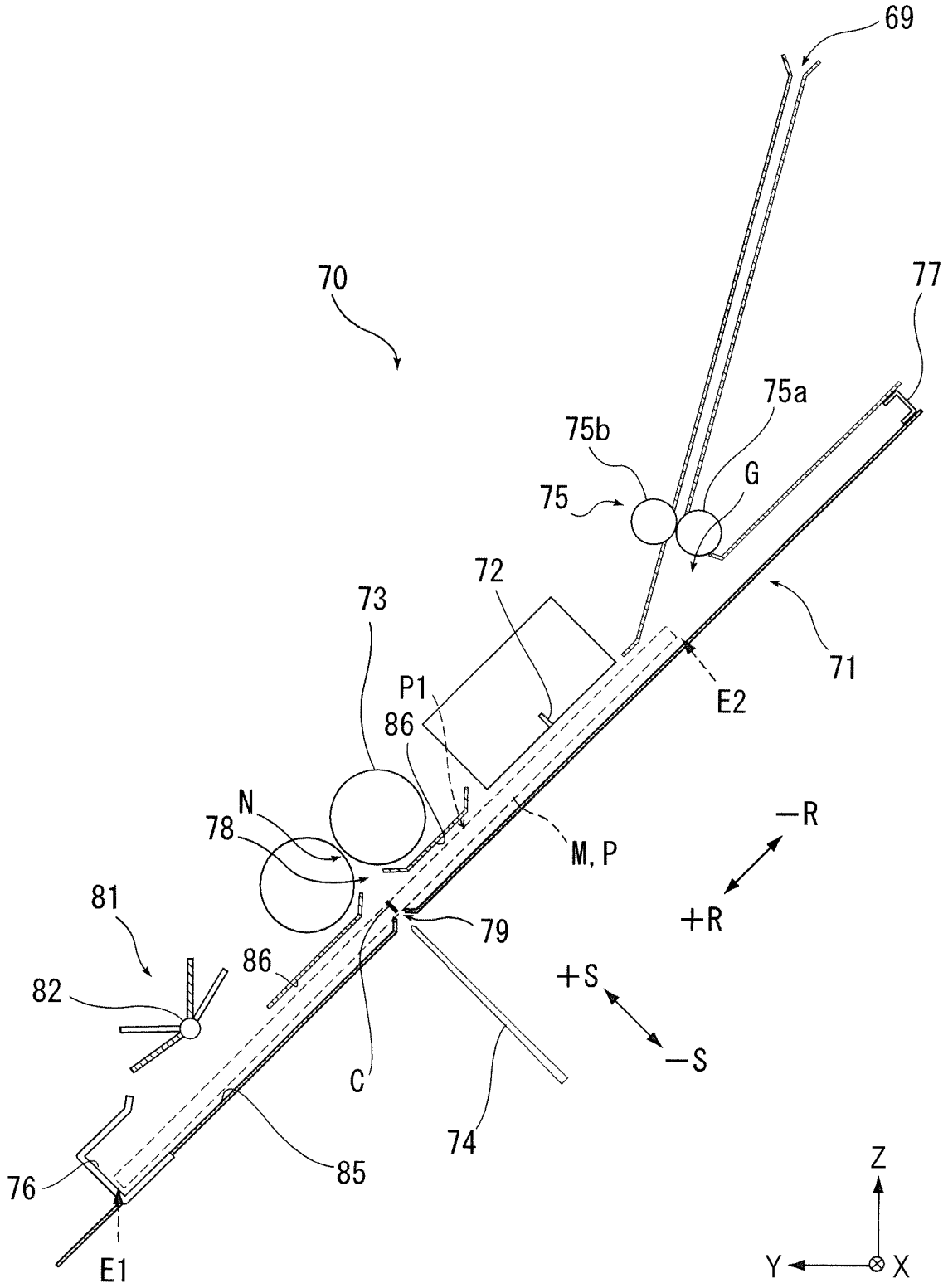
FIG. 6 is a side sectional view of a saddle stitching processing unit.

As illustrated in FIG. 6, the stacking unit 71 includes an alignment unit 76 that aligns a downstream end E1 of the stacked medium P and a paddle 81. The feeding roller pair 75 includes a driving roller 75*a* driven by a driving source which is not illustrated and a driven roller 75*b* driven to rotate by rotation of the driving roller 75*a*. The driving roller 75*a* is controlled by the control unit 25 to rotate.

In FIG. 6, the stacking unit 71 receives and stacks the medium P transported by the feeding roller pair 75, between a support surface 85 that supports the medium P in an inclined posture in which the downstream of a transport direction +R faces the lower side and an opposite surface 86 opposite to the support surface 85. The paddle 81 is provided between the feeding roller pair 75 and the alignment unit 76 in the transport direction +R and is rotated about a rotary shaft 82 while contacting the medium P, to move the medium P to the alignment unit 76.

In FIG. 6, reference sign G indicates a junction position G where the transport path 69 and the stacking unit 71 are joined to each other. Further, in the present embodiment, the stitched position is a central portion C of the medium P stacked on the stacking unit 71 in the transport direction +R. The medium P is sent from the transport path 69 to the stacking unit 71 by the feeding roller pair 75.

The stacking unit 71 is provided with the alignment unit 76 that can come into contact with the downstream end E1 of the medium P stacked on the stacking unit 71 in the transport direction +R and an abutting unit 77 that can come into contact with a downstream end E2 of the medium P stacked on the stacking unit 71 in the transport direction +R.

The alignment unit 76 and the abutting unit 77 are configured to be movable in both the transport direction +R of the medium P and an opposite direction −R thereto in the stacking unit 71 illustrated in FIG. 6. The alignment unit 76 and the abutting unit 77 can be moved in the transport direction +R or the opposite direction −R using, for example, a rack and pinion mechanism, a belt moving mechanism, or the like operated by power of a driving source which is not illustrated. The movement of the alignment unit 76 and the abutting unit 77 will be described in detail when a stacking operation of the stacking unit 71 is described.

The stitching unit 72 that stitches the bundle M of the media stacked on the stacking unit 71 at a predetermined position in the transport direction +R is provided downstream of the junction position G. The stitching unit 72 is, for example, a stapler. A plurality of the stitching units 72 are provided at intervals in the X axis direction that is the width direction of the medium. As described above, the stitching unit 72 is configured to stitch the bundle M of the media with a central portion C of the bundle M of the media as the stitched position in the transport direction +R.

In FIG. 6, the folding roller pair 73 is provided downstream of the stitching unit 72. The opposite surface 86 is open at a position corresponding to a nip position N of the folding roller pair 73, and an approach path 78 of the bundle M of the media is formed from the stacking unit 71 to the folding roller pair 73. A slope that guides the central portion C that is the stitched position from the stacking unit 71 to the nip position N is formed at an entrance of the approach path 78 of the opposite surface 86.

Figure 8:
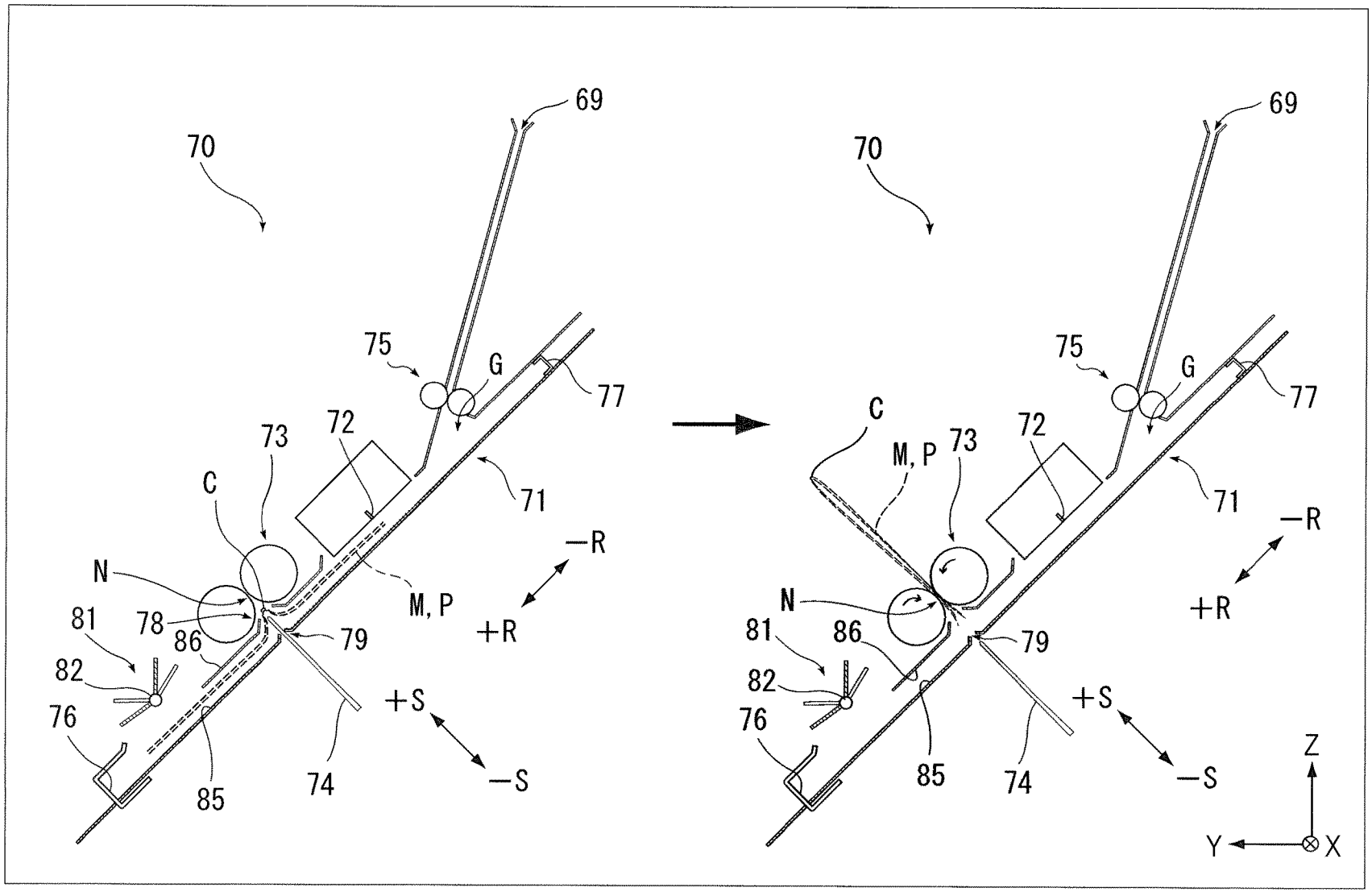
FIG. 8 is a diagram for illustrating saddle stitching processing in the saddle stitching processing unit.

A blade 74, which can switch between a retracted state in which the blade 74 is retracted from the stacking unit 71 as illustrated in FIG. 6 and an advanced state in which the blade 74 is advanced with respect to the stitched position of the bundle M of the media stacked on the stacking unit 71 as illustrated in a left view of FIG. 8, is provided on an opposite side to the folding roller pair 73 with the stacking unit 71 in between. A hole 79 is provided on the support surface 85, and the blade 74 can pass through the hole 79.

Regarding Transport of Medium During Saddle Stitching Processing

Next, a basic flow in which the medium P in the second unit 6 is transported, is saddle-stitching-processed, and is discharged will be described with reference to FIGS. 6 to 8.

In FIG. 6, the medium P transported to the stacking unit 71 moves toward the alignment unit 76 by a self-weight thereof, and the paddle 81 is rotated whenever the one medium P is transported, so that the medium P is abutted against the alignment unit 76.

FIG. 6 shows a state in which a plurality of the media P are stacked on the stacking unit 71 as the bundle M of the media.

Further, when the medium is received in the stacking unit 71, as illustrated in FIG. 6, the alignment unit 76 is disposed such that a distance from the junction position G between the transport path 69 and the stacking unit 71 to the alignment unit 76 is longer than the length of the medium P. Accordingly, the upstream end E2 of the medium P transported from the transport path 69 does not remain in the transport path 69, and the medium P is received by the stacking unit 71. The position of the alignment unit 76 of the stacking unit 71 in the transport direction +R may be changed according to the size of the medium P.

When a predetermined number of media P are stacked on the stacking unit 71, the stitching processing is performed in which the central portion C of the bundle M of the media in the transport direction +R is stitched by the stitching unit 72. When the transport of the medium P from the transport path 69 to the stacking unit 71 is completed, as illustrated in FIG. 6, since the central portion C deviates from the position of the stitching unit 72, the alignment unit 76 is moved in the −R direction as illustrated in a left view of FIG. 7, so that the central portion C of the bundle M of the media is disposed at a position facing the stitching unit 72. Further, the abutting unit 77 is moved in the +R direction to come into contact with the upstream end E2 of the bundle M of the media. The downstream end E1 and the upstream end E2 of the bundle M of the media are aligned by the alignment unit 76 and the abutting unit 77, and the central portion C of the bundle M of the media is stitched by the stitching unit 72.

Figure 7:
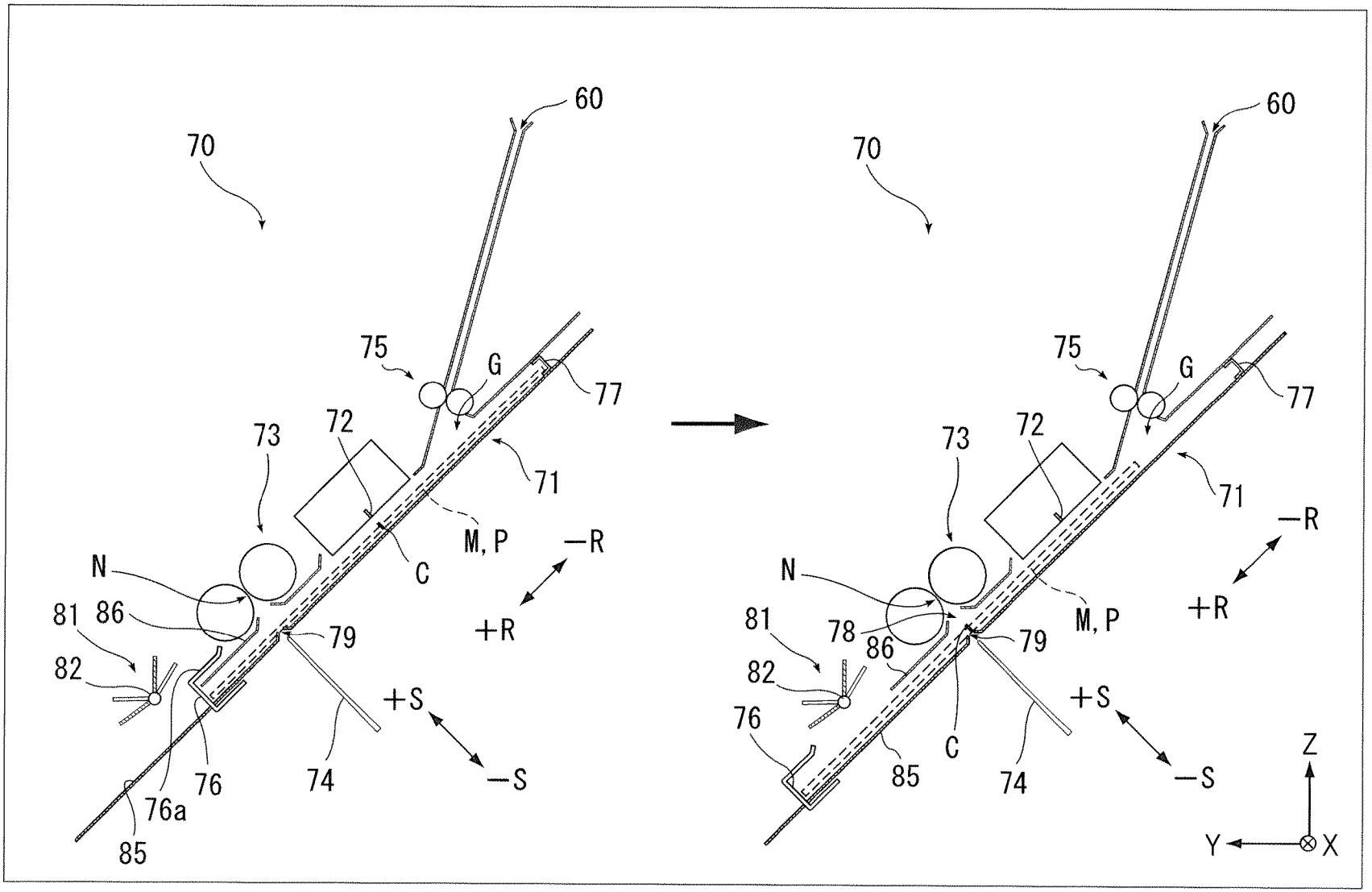
FIG. 7 is a diagram for illustrating saddle stitching processing in the saddle stitching processing unit.

After the bundle M of the media is stitched by the stitching unit 72, as illustrated in a right view of FIG. 7, the alignment unit 76 is moved in the +R direction, and the bundle M of the media is moved such that the stitched central portion C is disposed at a position facing the nip position N of the folding roller pair 73. While a state in which the bundle M of the media is in contact with the alignment unit 76 is maintained by a self-weight thereof, only the alignment unit 76 is moved in the +R direction, so that the bundle M of the media can be moved in the +R direction. Further, the abutting unit 77 may be moved in the +R direction to maintain a state in which the abutting unit 77 is in contact with the upstream end E2 of the bundle M of the media.

Next, when the central portion C of the bundle M of the media is disposed at a position facing the nip position N of the folding roller pair 73, as illustrated in the left view of FIG. 8, the blade 74 is advanced in a +S direction to bend the central portion C toward the folding roller pair 73. The central portion C of the bundle M of the bent media is moved toward the nip position N of the folding roller pair 73 through the approach path 78.

When the central portion C of the bundle M of the media is nipped by the folding roller pair 73, the folding roller pair 73 is rotated. As illustrated in a right view of FIG. 8, the bundle M of the media is discharged toward the second tray 65 (FIG. 1) while being folded at the central portion C by the nip pressure of the folding roller pair 73.

Further, after the central portion C is nipped by the folding roller pair 73, the alignment unit 76 is moved in the +R direction, returns to the state of FIG. 6, and prepares for reception of a next medium P in the stacking unit 71.

Further, the transport path 69 may be provided with a fold forming unit that attaches a fold to the central portion C of the medium P. By attaching a fold to the central portion C that is a folded position by the folding roller pair 73, the bundle M of the media can be easily folded at the central portion C.

Second Embodiment

A second embodiment will be described with reference to FIGS. 9 and 10. Further, in the following embodiments, the same components as those of the first embodiment are denoted by the same reference numerals, and description of the components will be omitted.

A first unit 5A as a medium processing apparatus according to the second embodiment includes the drying unit 50 as the first processing unit, the end stitching unit 42 as the second processing unit, and the saddle stitching processing unit 70, in one unit.

Figure 9:
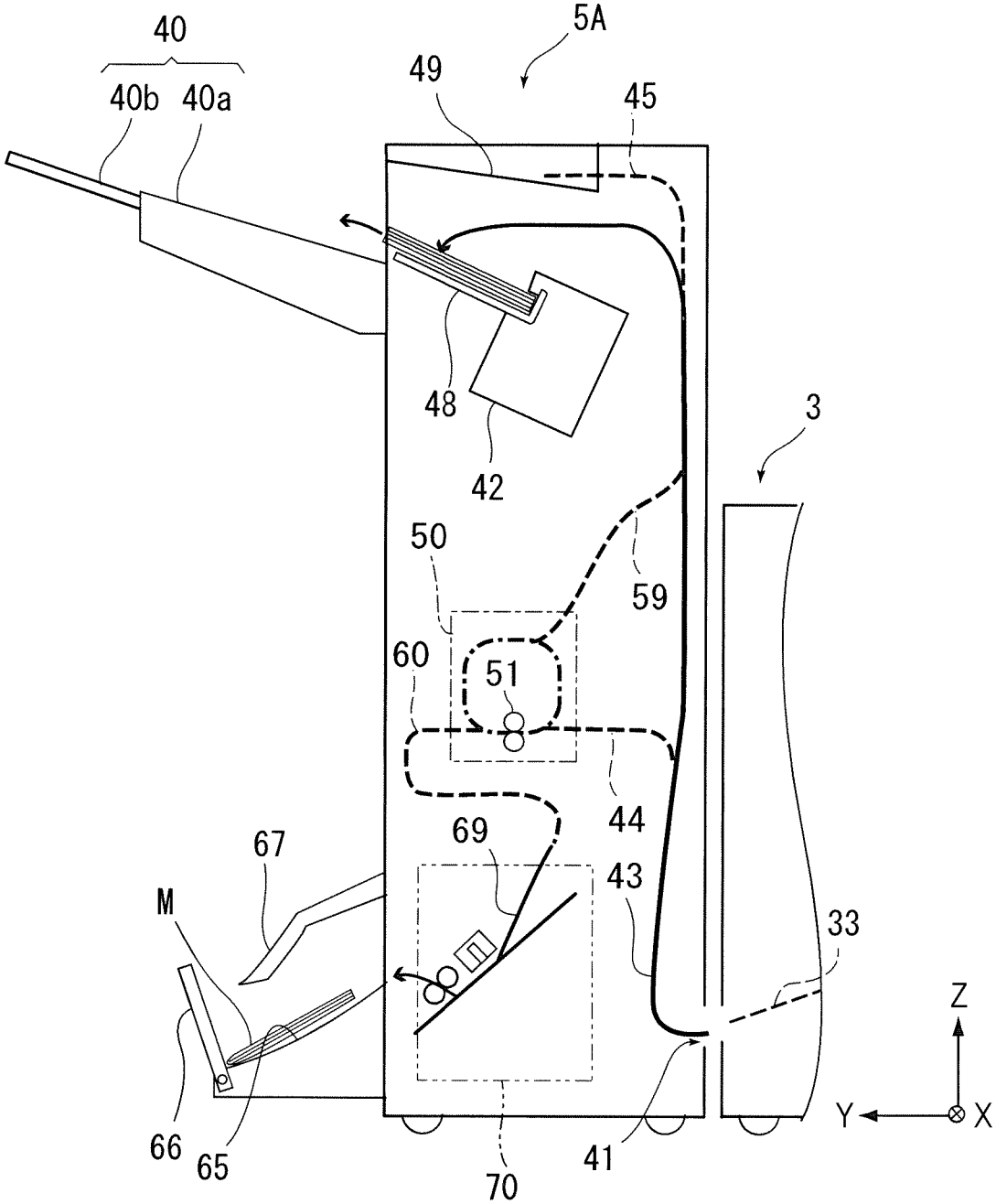
FIG. 9 is a schematic view illustrating a first unit according to a second embodiment.
Figure 10:
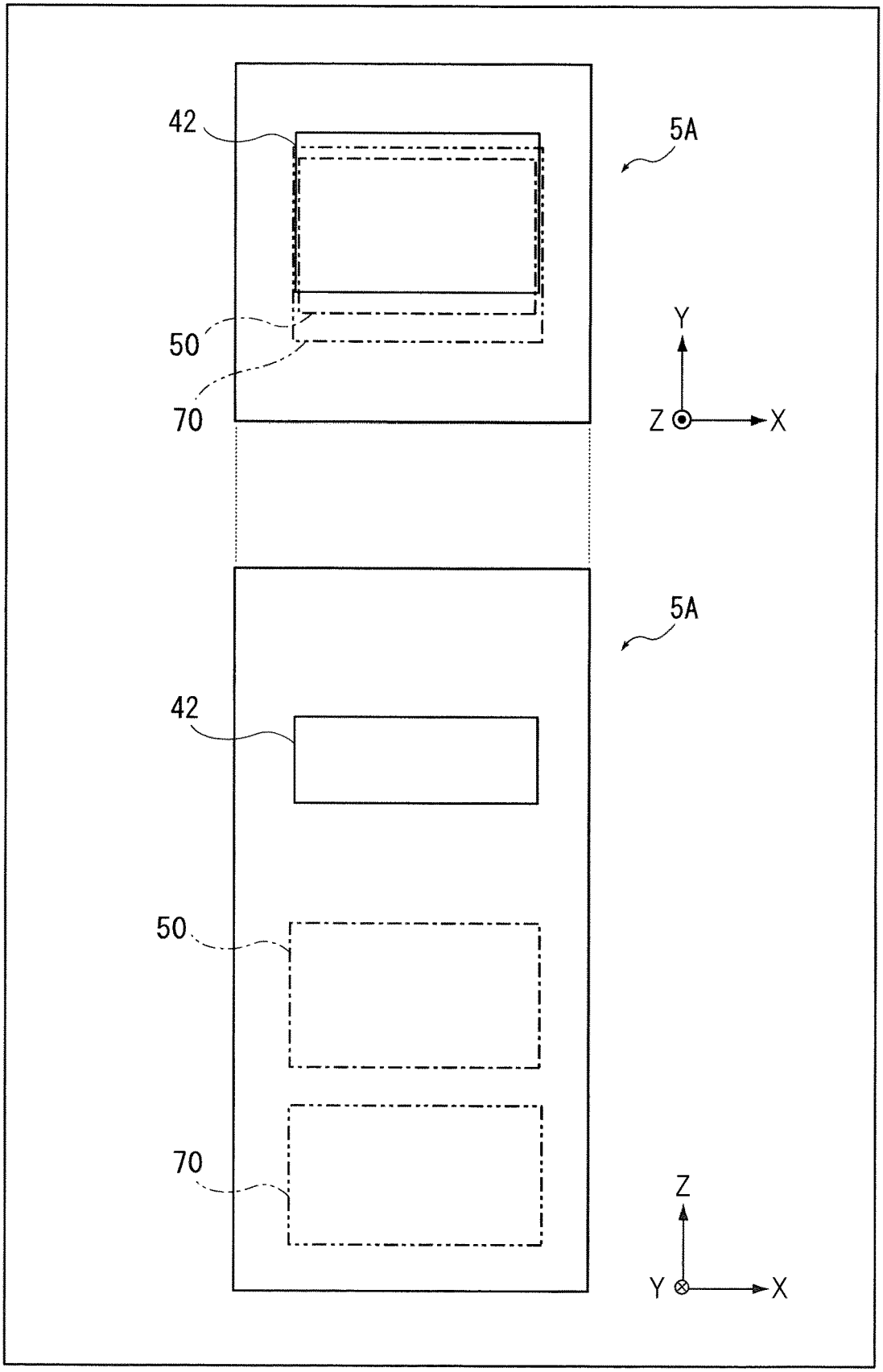
FIG. 10 is a diagram for illustrating arrangement of an end stitching unit, a drying unit, and a saddle stitching processing unit of the first unit according to the second embodiment.

Then, as illustrated in FIG. 9 and a lower view of FIG. 10, the saddle stitching processing unit 70 is located in a −Z direction that is a vertically downward direction of the drying unit 50, that is, the end stitching unit 42, the drying unit 50, and the saddle stitching processing unit 70 are arranged from the upper side in the order thereof. As illustrated in an upper view of FIG. 10, the drying unit 50, the end stitching unit 42, and the saddle stitching processing unit 70 have an overlapping portion when viewed in a vertical direction, that is, when viewed in an upper surface. Alternatively, only the drying unit 50 and the saddle stitching processing unit 70 may overlap each other, or only the end stitching unit 42 and the saddle stitching processing unit 70 may overlap each other.

Since the end stitching unit 42, the drying unit 50, and the saddle stitching processing unit 70 are arranged in one unit as described above, while an increase in the horizontal dimension of the apparatus is suppressed and the apparatus is miniaturized, all of the drying processing, the end stitching processing, and the saddle stitching processing can be performed by one apparatus.

Third Embodiment

A third embodiment will be described with reference to FIGS. 11 and 12.

Similarly to the first unit 5A according to the second embodiment, one first unit 5B as a medium processing apparatus according to the third embodiment includes the drying unit 50 as the first processing unit, the end stitching unit 42 as the second processing unit, and the saddle stitching processing unit 70.

Figure 11:
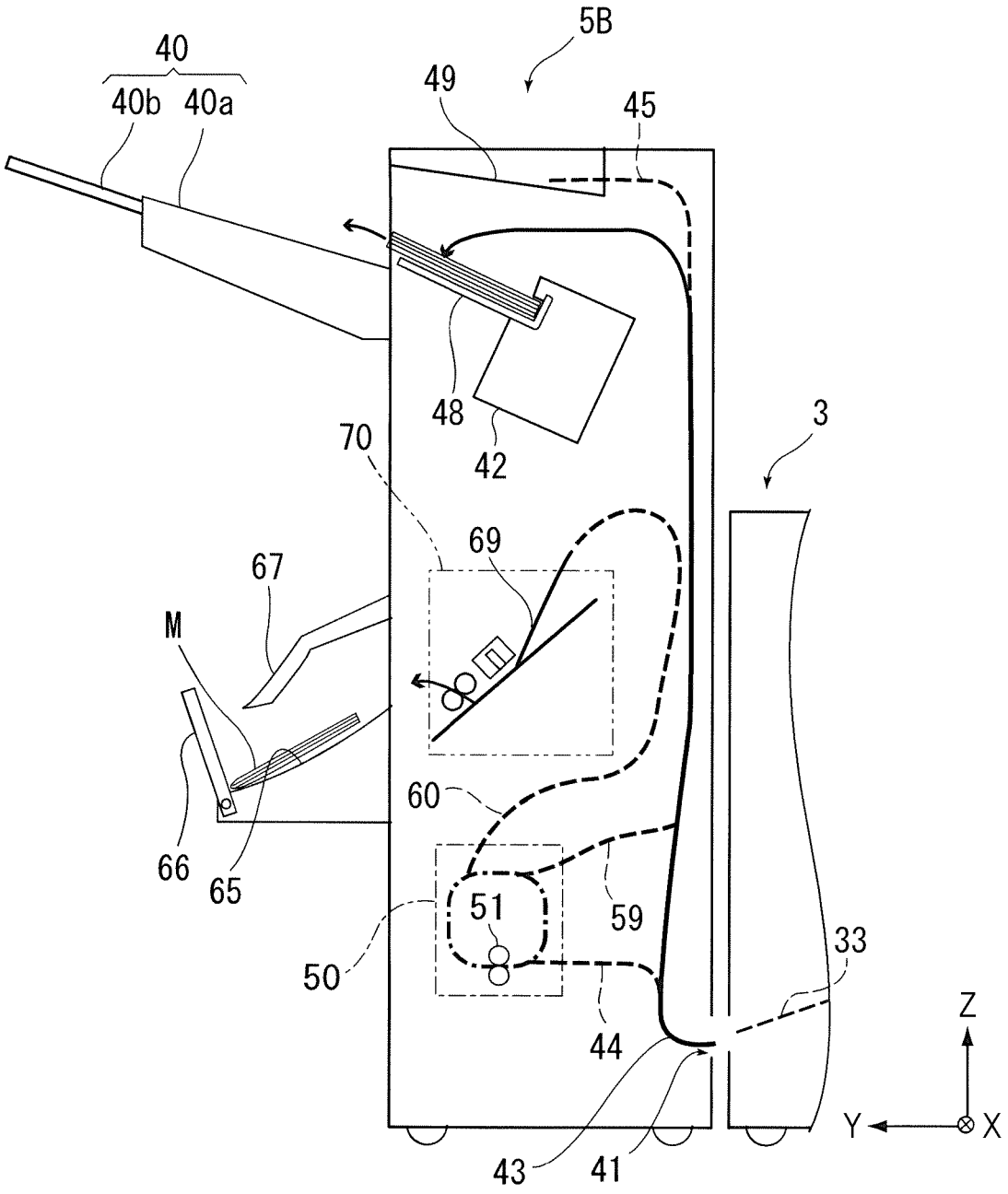
FIG. 11 is a schematic view illustrating a first unit according to a third embodiment.
Figure 12:
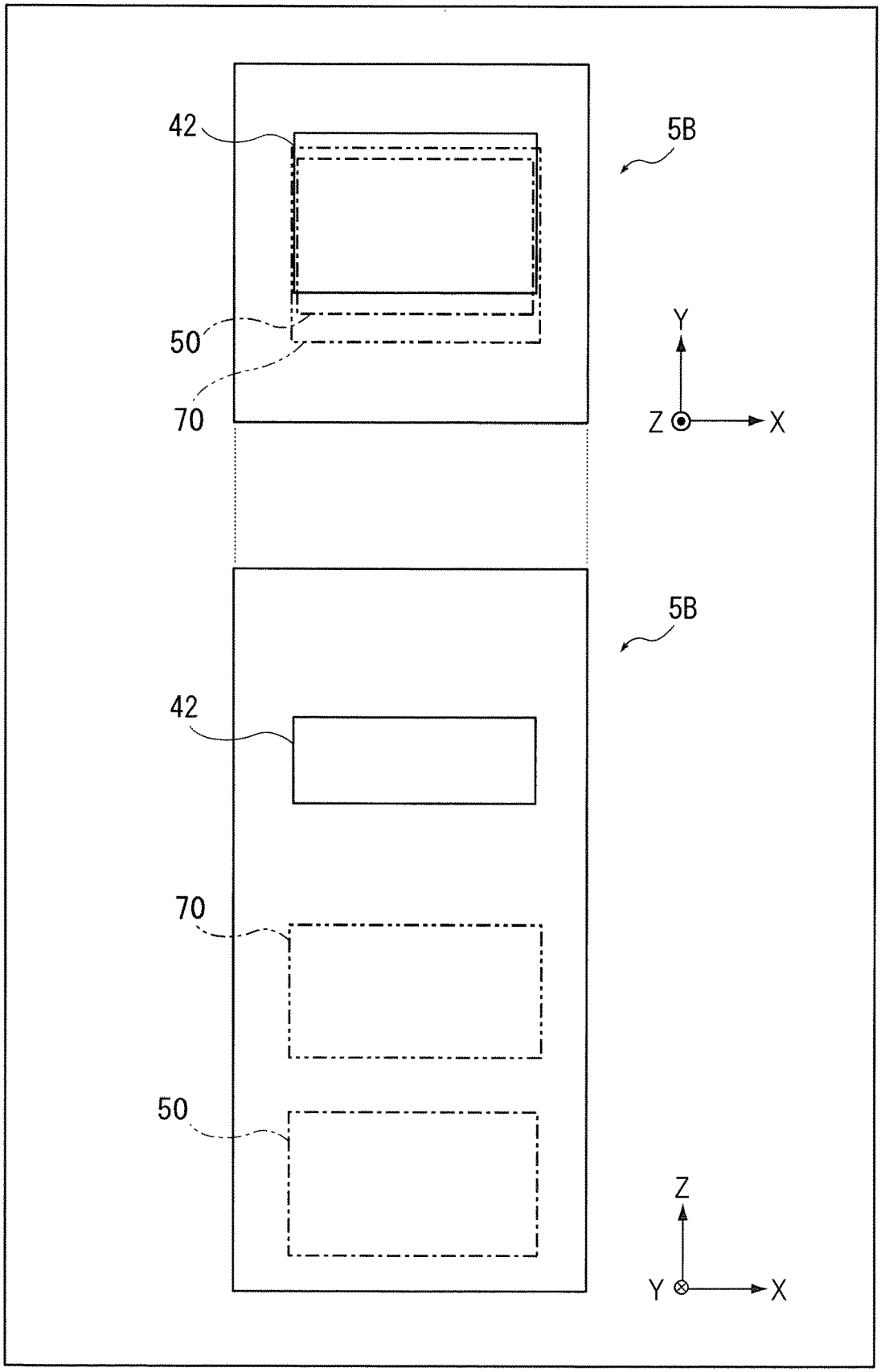
FIG. 12 is a diagram for illustrating arrangement of an end stitching unit, a drying unit, and a saddle stitching processing unit of the first unit according to the third embodiment.

Then, as illustrated in FIG. 11 and a lower view of FIG. 12, the saddle stitching processing unit 70 is located between the drying unit 50 and the end stitching unit 42 in the vertical direction, that is, the end stitching unit 42, the saddle stitching processing unit 70, and the drying unit 50 are arranged from the upper side in the order thereof. As illustrated in an upper view of FIG. 12, the drying unit 50, the end stitching unit 42, and the saddle stitching processing unit 70 have an overlapping portion when viewed in a vertical direction, that is, when viewed in an upper side. Alternatively, only the drying unit 50 and the saddle stitching processing unit 70 may overlap each other, or only the end stitching unit 42 and the saddle stitching processing unit 70 may overlap each other.

As the end stitching unit 42, the drying unit 50, and the saddle stitching processing unit 70 are arranged in one unit as described above, while an increase in the horizontal dimension of the apparatus is suppressed and the apparatus is miniaturized, all of the drying processing, the end stitching processing, and the saddle stitching processing can be performed by one apparatus.

Further, it is apparent that the present disclosure is not limited to the above-described embodiments, various modifications can be made without departing from the scope of the present disclosure described in the appended claims, and the modifications are also included in the scope of the present disclosure.

What is claimed is:

1. A medium processing apparatus comprising:

a receiving portion that receives media to be processed;

a transport path that transports the media received from the receiving portion;

a first processing unit that performs first processing on the media received from the receiving portion;

a second processing unit that performs second processing on the media received from the receiving portion and not processed by the first processing unit or the media received from the receiving portion and processed by the first processing unit; and a third processing unit that performs third processing on the media received from the receiving portion, wherein the first processing is processing of drying the media, and the first processing unit has a portion overlapping with the second processing unit and the third processing unit when viewed in a vertical direction.

2. The medium processing apparatus according to claim 1, wherein the first processing unit and the third processing unit are located vertically below the second processing unit.

3. The medium processing apparatus according to claim 1, wherein the second processing is end stitching processing of stitching ends of the media.

4. The medium processing apparatus according to claim 1, wherein the transport path includes a first transport path that transports the media received from the receiving portion to the second processing unit, and the third processing unit is located at the first transport path.

5. The medium processing apparatus according to claim 1, wherein the third processing unit is a stacking processing unit that stacks a plurality of the media received from the receiving portion and sends the plurality of the media to the first processing unit or the second processing unit.

6. The medium processing apparatus according to claim 1, wherein the third processing unit is a punching processing unit that performs punching processing on the media received from the receiving portion.

7. The medium processing apparatus according to claim 1, wherein the third processing unit is located vertically below the first processing unit.

8. The medium processing apparatus according to claim 1, wherein the third processing unit is located between the first processing unit and the second processing unit in the vertical direction.

9. The medium processing apparatus according to claim 1, wherein the third processing unit is a saddle stitching processing unit that stitches central portions of the media received from the receiving portion in a medium transport direction.

10. The medium processing apparatus according to claim 1, further comprising:

a first discharge section that discharges the media processed by the first processing unit to an outside of the medium processing apparatus;

a second discharge section that discharges the media processed by the second processing unit to the outside of the medium processing apparatus; and a tray that receives the media discharged from the second discharge section, wherein a saddle stitching unit that is provided outside the medium processing apparatus, receives the media discharged from the first discharge section, and performs saddle stitching processing of stitching central portions of the media in a medium discharge direction is configured to be attachable to and detachable from the medium processing apparatus below the tray.

11. The medium processing apparatus according to claim 1, wherein the first processing unit includes a drying processing unit that performs drying processing on the media, and a loop-like transport path including the drying processing unit and configured to circumferentially transport the media.

12. The medium processing apparatus according to claim 9, further comprising:

a first switching member that switches to a first state in which the media processed by the first processing unit are sent to a first discharge section; and a second switching member that switches to a second state in which the media processed by the first processing unit are sent to the second processing unit.

13. The medium processing apparatus according to claim 10, wherein the loop-like transport path is accommodated within an area of the second processing unit in the vertical direction when viewed in a horizontal direction.

14. The medium processing apparatus according to claim 1, wherein the receiving portion are located vertically below the first processing unit.

15. A recording system comprising:

a recording unit that includes a recording section recording on a medium; and the medium processing apparatus according to claim 1, which processes the medium after the recording by the recording section.

16. A recording system comprising:

a recording unit that includes a recording section performing recording on a medium;

the medium processing apparatus according to claim 1, which processes the medium after the recording by the recording section; and a saddle stitching unit that is provided outside the medium processing apparatus, receives the medium discharged from the medium processing apparatus, and performs saddle stitching processing of stitching a central portion of the medium in a medium discharge direction;

a saddle stitching unit that is provided outside the medium processing apparatus, receives the medium discharged from the medium processing apparatus, and performs saddle stitching processing of stitching a central portion of the medium in a medium discharge direction.

* * * * *